US007699650B1

(12) United States Patent
Liao et al.

(10) Patent No.: US 7,699,650 B1
(45) Date of Patent: Apr. 20, 2010

(54) ELECTRONIC DEVICE WITH VOLTAGE-RESISTANT CONNECTORS

(75) Inventors: Yu-Hsiang Liao, Jhongli (TW); Chih-Chan Ger, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 0 days.

(21) Appl. No.: 12/493,132

(22) Filed: Jun. 26, 2009

(30) Foreign Application Priority Data

Dec. 5, 2008 (CN) ..... 2008 2 0234832

(51) Int. Cl.
*H01R 17/73* (2006.01)

(52) U.S. Cl. ..... 439/573; 439/553; 439/934

(58) Field of Classification Search ..... 439/553, 439/569, 572, 573, 934
See application file for complete search history.

(56) References Cited

U.S. PATENT DOCUMENTS 3,218,448 A * 11/1965 Cala ..... 362/549
3,641,474 A * 2/1972 Owens ..... 439/78
3,801,874 A * 4/1974 Stefani ..... 361/709
4,435,031 A * 3/1984 Black et al. ..... 439/82
4,646,203 A * 2/1987 Ngo et al. ..... 361/708
5,044,988 A * 9/1991 Hirayama ..... 439/571
5,636,937 A * 6/1997 Zemlicka ..... 403/388
6,203,364 B1 * 3/2001 Chupak et al. ..... 439/527
6,565,362 B2 * 5/2003 Hayashi ..... 439/34
7,192,314 B1 * 3/2007 Shiu ..... 439/669
2006/0205271 A1 * 9/2006 Hsu ..... 439/573

* cited by examiner

*Primary Examiner*—Neil Abrams
(74) *Attorney, Agent, or Firm*—Raymond J. Chew

(57) ABSTRACT

An electrical device includes a conductive member and a voltage-resistant connector to be mounted to the metal enclosure. The conductive member such as a metal enclosure, includes a pair of clasping portions separated from each other. Each of the pair of clasping portions includes a pair of fixing arms. The voltage-resistant connector includes a main body to electrically connect a high-voltage output and a load of the electrical device, and an insulated member between the main body and the conductive member to increase a beeline distance between the voltage-resistant connector and the insulated member to avoid arcing therebetween. The insulated member defines a pair of holes corresponding to the clasping portions. The pair of fixing arms of each of the pair of clasping portion extends through a corresponding hole and clasps the insulated member to fix the voltage-resistant connector on the conductive member.

5 Claims, 2 Drawing Sheets

ELECTRONIC DEVICE WITH VOLTAGE-RESISTANT CONNECTORS

BACKGROUND

1. Technical Field

The present disclosure generally relates to electronic devices, and more particularly to an electronic device with a voltage-resistant connector that electrically connects a high-voltage output and a load of the electrical device.

2. Description of Related Art

In a liquid crystal display (LCD), a voltage-resistant connector is used to connect a high-voltage output and a load. Often, the voltage-resistant connector is secured to a conductive member, such as a metal enclosure, of the LCD with double-sided tape. A beeline distance between the voltage-resistant connector and the metal enclosure is equal to a thickness of a plastic housing of the voltage-resistant connector, resulting in arcing between the voltage-resistant connector and the metal enclosure.

Therefore, a need exists in the industry to overcome the described limitations.

DETAILED DESCRIPTION

Figure 1:
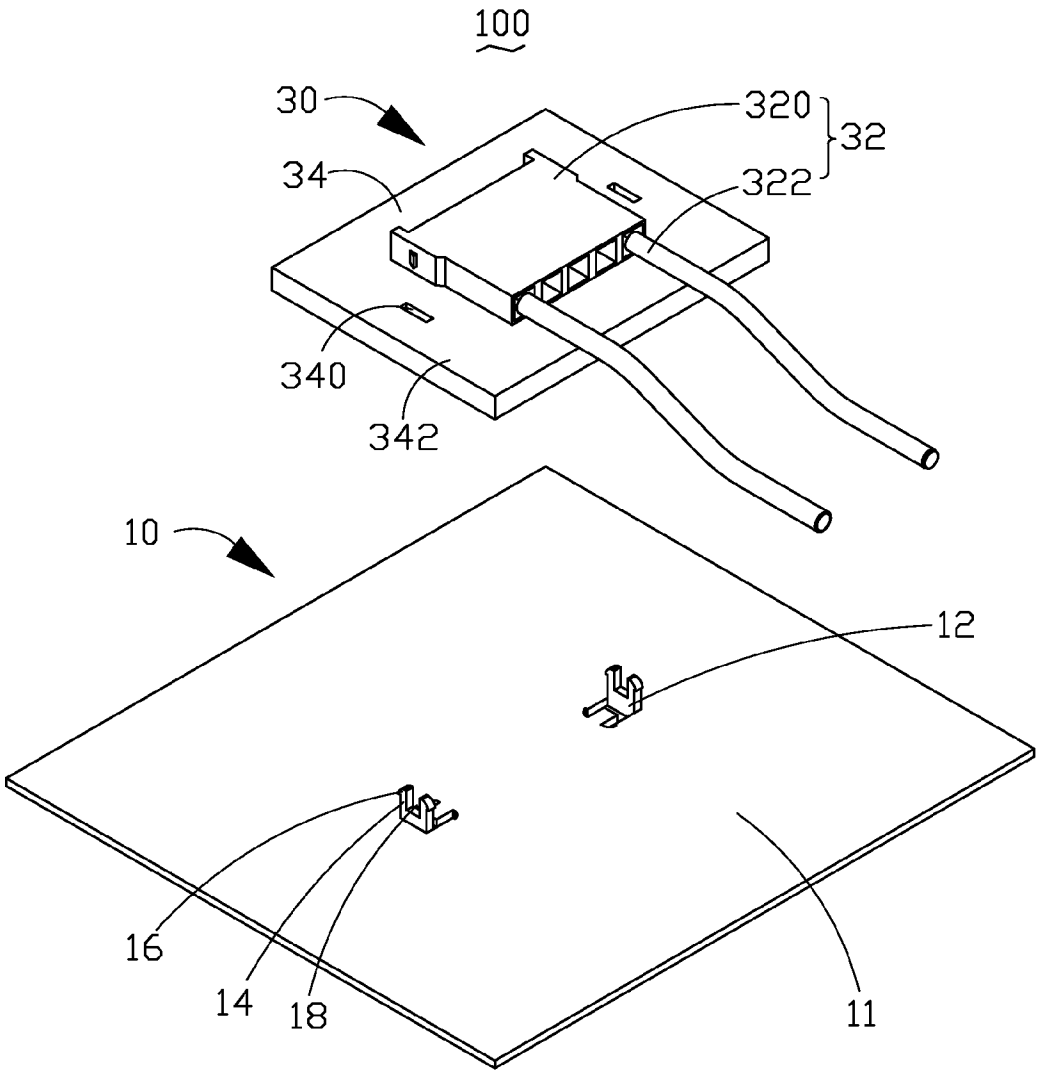
FIG. 1 is an exploded, isometric view of an electronic device of an exemplary embodiment of the disclosure.

FIG. 1 is an exploded, isometric view of an electronic device 100 of an exemplary embodiment of the disclosure. The electronic device 100 includes a conductive member 10 and a voltage-resistant connector 30 to electrically connect a high-voltage output and a load of the electronic device 100. The electronic device 100 is disclosed as a liquid crystal display (LCD), but the disclosure is not limited thereto.

The conductive member 10 includes a main plate 11 and a pair of clasping portions 12 projecting from a surface of the main plate 11 and separated from each other. Each of the pair of clasping portions 12 includes a pair of fixing arms 14, a pair of hooks 16 each located at a distal end of each of the pair of fixing arms 14, and a groove 18 between the pair of fixing arms 14 to provide good resilience for the pair of fixing arms 14.

The voltage-resistant connector 30 is attached to the conductive member 10, and includes a main body 32 and an insulated member 34. The main body 32 includes a plastic housing 320 and a connecting portion 322 to electrically connect the high-voltage output and the load of the electronic device 100.

The insulated member 34 is integrally formed with the main body 32 to increase a beeline distance between the voltage-resistant connector 30 and the inductive member 10 to avoid arcing therebetween. The insulated member 34 defines a pair of holes 340 corresponding to the pair of clasping portions 12. The main body 32 is between the pair of holes 340. In the illustrated embodiment, a length and a width of the insulated member 34 are substantially greater than a length and a width of the main body 32. Alternatively, the length and the width of the insulated member 34 may be equal to the length and the width of the main body 32.

Alternatively, the voltage-resistant connector 30 can include a pair of insulated members 34 positioned on two opposite sides of the main body 32 to increase a beeline distance between the voltage-resistant connector 30 and each of the pair of conductive members 10 to avoid arcing therebetween.

Alternatively, the main body 32 may be soldered on the insulated member 34, in one example. However, it may be understood by those of ordinary skill in the art that the main body 32 may be mounted on the insulated member 34 using other techniques.

Figure 2:
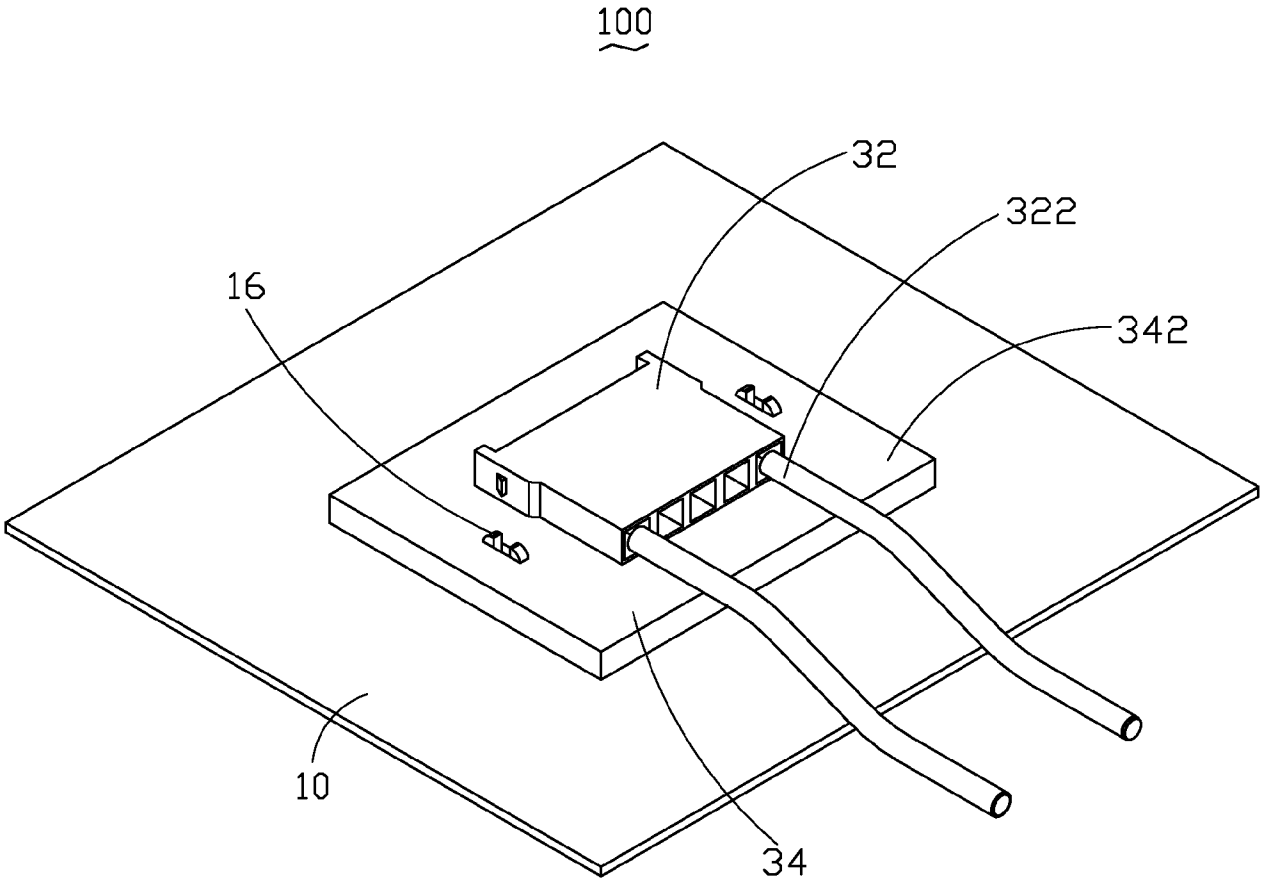
FIG. 2 is an assembled view of FIG. 1.

Referring to FIG. 2, in assembly, the pair of fixing arms 14 of each of the pair of clasping portions 12 extend through a corresponding hole 340 of the insulated member 34 with the pair of hooks firmly clasping a surface 342 of the insulated member 34. Thus, the voltage-resistant connector 30 is fixed on the inductive member 10.

Because each of the plurality of hooks 16 firmly clasps the surface 342 of the insulated member 34, the plurality of fixing arms 14 cannot accidentally disengage from the holes 340. That is, the voltage-resistant connector cannot accidentally disengage from the conductive member, increasing protection of the voltage-resistant connector from damage.

Because the fixing arms 14 have good resilience, the fixing arms 14 can be easily received in or removed from the holes 340 of the insulated member 34. Thus, assembly or disassembly of the conductive member 10 and the voltage-resistant connector 30 is simplified.

A beeline distance between the voltage-resistant connector 30 and the inductive member 10 is approximately equal to the sum of a thickness of the insulated portion 34 and a thickness of the housing 320. That is, a safety distance between the voltage-resistant connector 30 and the inductive member 10 is increased, resulting in avoiding arcing therebetween.

While an embodiment of the present disclosure has been described, it should be understood that it has been presented by way of example only and not by way of limitation. Thus the breadth and scope of the present disclosure should not be limited by the above-described exemplary embodiments, but should be defined only in accordance with the following claims and their equivalents.

What is claimed is:

1. An electrical device comprising:

a conductive member comprising a pair of clasping portions separated from each other, each of the pair of clasping portions comprising a pair of fixing arms; and a voltage-resistant connector attached to the conductive member, the voltage-resistant connector comprising a main body to electrically connect a high-voltage output and a load of the electrical device, and an insulated member between the main body and the inductive member to increase a beeline distance between the voltage-resistant connector and the insulated member to avoid arcing therebetween, wherein the insulated member defines a pair of holes corresponding to the pair of clasping portions;

wherein the pair of fixing arms of each of the pair of clasping portions extend through a corresponding hole and clasp the insulated member to fix the voltage-resistant connector on the conductive member.

2. The electrical device as recited in claim 1, wherein the insulated member is integrally formed with the main body.

3. The electrical device as recited in claim 1, wherein each of the pair of clasping portions defines a groove between the pair of fixing arms to provide resilience for the pair of fixing arms.

4. The electrical device as recited in claim 3, wherein each of the plurality of fixing arms comprises a hook locating a distal end thereof to firmly clasp the insulated member.

5. The electrical device as recited in claim 1, wherein the main body comprises a housing and a connecting portion to electrically connect the high-voltage output and the load.

* * * * *